US007527479B2

(12) United States Patent
Shi et al.

(10) Patent No.: US 7,527,479 B2
(45) Date of Patent: May 5, 2009

(54) MECHANICAL COUPLING FOR A ROTOR SHAFT ASSEMBLY OF DISSIMILAR MATERIALS

(75) Inventors: Jun Shi, Glastonbury, CT (US); David Bombara, New Hartford, CT (US); Kevin E. Green, Broad Brook, CT (US); Connic Bird, Rocky Hill, CT (US); John Holowczak, South Windsor, CT (US)

(73) Assignee: Hamilton Sundstrand Corporation, Rockford, IL (US)

( * ) Notice: Subject to any disclaimer, the term of this patent is extended or adjusted under 35 U.S.C. 154(b) by 585 days.

(21) Appl. No.: 11/221,440

(22) Filed: Sep. 8, 2005

(65) Prior Publication Data

US 2007/0237646 A1 Oct. 11, 2007

(51) Int. Cl.
*F04D 29/00* (2006.01)

(52) U.S. Cl. ..... 416/241 R; 416/241 A; 416/241 B; 416/244 R; 416/244 A

(58) Field of Classification Search ..... 416/241 R, 416/241 A, 241 B, 244 A, 244 R
See application file for complete search history.

(56) References Cited

U.S. PATENT DOCUMENTS 2,613,058 A * 10/1952 Atkinson ..... 416/92
3,467,419 A * 9/1969 Anderson et al. ..... 403/380
3,601,501 A * 8/1971 Johnson et al. ..... 416/244 R
3,884,093 A * 5/1975 Rabenhorst ..... 74/572.1
3,943,703 A * 3/1976 Kronogard ..... 60/791
4,011,737 A * 3/1977 Kruger et al. ..... 464/137
4,123,199 A 10/1978 Shimizu et al.
4,639,194 A 1/1987 Bell, III et al.
4,643,648 A 2/1987 Huller
4,934,138 A 6/1990 Boyd
5,104,747 A 4/1992 Makino et al.
5,881,607 A 3/1999 Ito et al.
6,250,883 B1 6/2001 Robinson et al.

* cited by examiner

*Primary Examiner*—Igor Kershteyn
(74) *Attorney, Agent, or Firm*—Carlson, Gaskey & Olds PC

(57) ABSTRACT

A mechanical coupling for coupling a ceramic disc member to a metallic shaft includes a first wedge clamp and a second wedge clamp. A fastener engages a threaded end of a tie-bolt to sandwich the ceramic disc between the wedge clamps. An axial spring is positioned between the fastener and the second wedge clamp to apply an axial preload along the longitudinal axis. Another coupling utilizes a rotor shaft end of a metallic rotor shaft as one wedge clamp. Still another coupling includes a solid ceramic rotor disc with a multiple of tie-bolts radially displaced from the longitudinal axis to exert the preload on the solid ceramic rotor disc.

14 Claims, 4 Drawing Sheets

MECHANICAL COUPLING FOR A ROTOR SHAFT ASSEMBLY OF DISSIMILAR MATERIALS

This invention was made with government support under U.S. Department of Energy Contract No. DE-FC26-00CH11060 (formerly DE-FC36-00CH11060 and DE-FC02-00CH11060). The government therefore has certain rights in this invention.

BACKGROUND OF THE INVENTION

The present invention relates to a rotor disc to shaft coupling, and more particularly to an axial mechanical coupling between a ceramic turbine rotor and a metal shaft.

Turbine inlet temperature strongly influences the thermal efficiency of a gas turbine: higher turbine inlet temperature generally leads to more thermally efficient gas turbines. However, higher turbine inlet temperature requires temperature and oxidation resistant materials such as ceramics. These components include ceramic turbine rotors that are typically attached to a metal shaft such that power is transmitted from the turbine rotor to a compressor rotor.

Connecting the ceramic turbine rotor to a metal shaft requires particular structural arrangements as ceramics thermally expand less than metals. The difference in thermal expansion results in thermal stress that may lessen the connection between the ceramic rotor and the metallic shaft. To maintain an effective joint between the rotor and the shaft, various brazing as well as mechanical clamp structures have been employed.

Brazing may be limited by the strength of the braze material and tends to soften above 900° F. Mechanical clamp structures are suited for application with higher temperatures but may be relatively complicated.

Accordingly, it is desirable to provide an uncomplicated mechanical coupling for coupling a ceramic member to a metal member that is capable of transmitting torque at relatively high temperatures.

SUMMARY OF THE INVENTION

A mechanical coupling for coupling a ceramic rotor disc to a metallic shaft according to the present invention includes a first wedge clamp and a second wedge clamp connected by a tie-bolt. A fastener such as a nut engages a threaded end of the tie-bolt to sandwich a ceramic turbine rotor between the wedge clamps. An axial spring such as a Bellville washer is positioned between the fastener and one wedge clamp to apply an axial preload along the longitudinal axis.

The turbine rotor includes a first rotor radial surface and a second rotor radial surface non-perpendicular to a rotational axis. The first rotor radial surface and the second rotor radial surface are preferably frustro-conical surfaces sloped at an angle of 45 degrees to the longitudinal axis. The first wedge clamp and the second wedge clamp define respective first and second radial surface which correspond to the first rotor radial surface and the second rotor radial surface. Tightening of the fastener onto the tie-bolt compresses the axial spring and sandwiches the ceramic turbine rotor between the wedge clamps to apply an axial preload onto the ceramic turbine rotor. The wedge clamps axially follow the deformation of the ceramic rotor due to the preload applied by the axial spring which still further minimizes the hoop stress at the rotor disc bore.

The wedge clamps include a multitude of cooling apertures through the wedge clamps which permit cooling air flow from the compressor side of the engine through the first wedge clamp, an inner bore of the ceramic turbine rotor and the second wedge clamp.

Another coupling utilizes a rotor shaft end of a metallic rotor shaft as one wedge clamp.

Still another coupling includes a solid ceramic rotor disc that does not utilize an inner bore. A multiple of tie-bolts radially displaced from the longitudinal axis are located through the ceramic rotor disc and the wedge clamps to exert a preload on the solid ceramic rotor disc.

The present invention therefore provide an uncomplicated mechanical coupling for coupling a ceramic member to a metal member that is capable of transmitting torque at relatively high temperatures.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
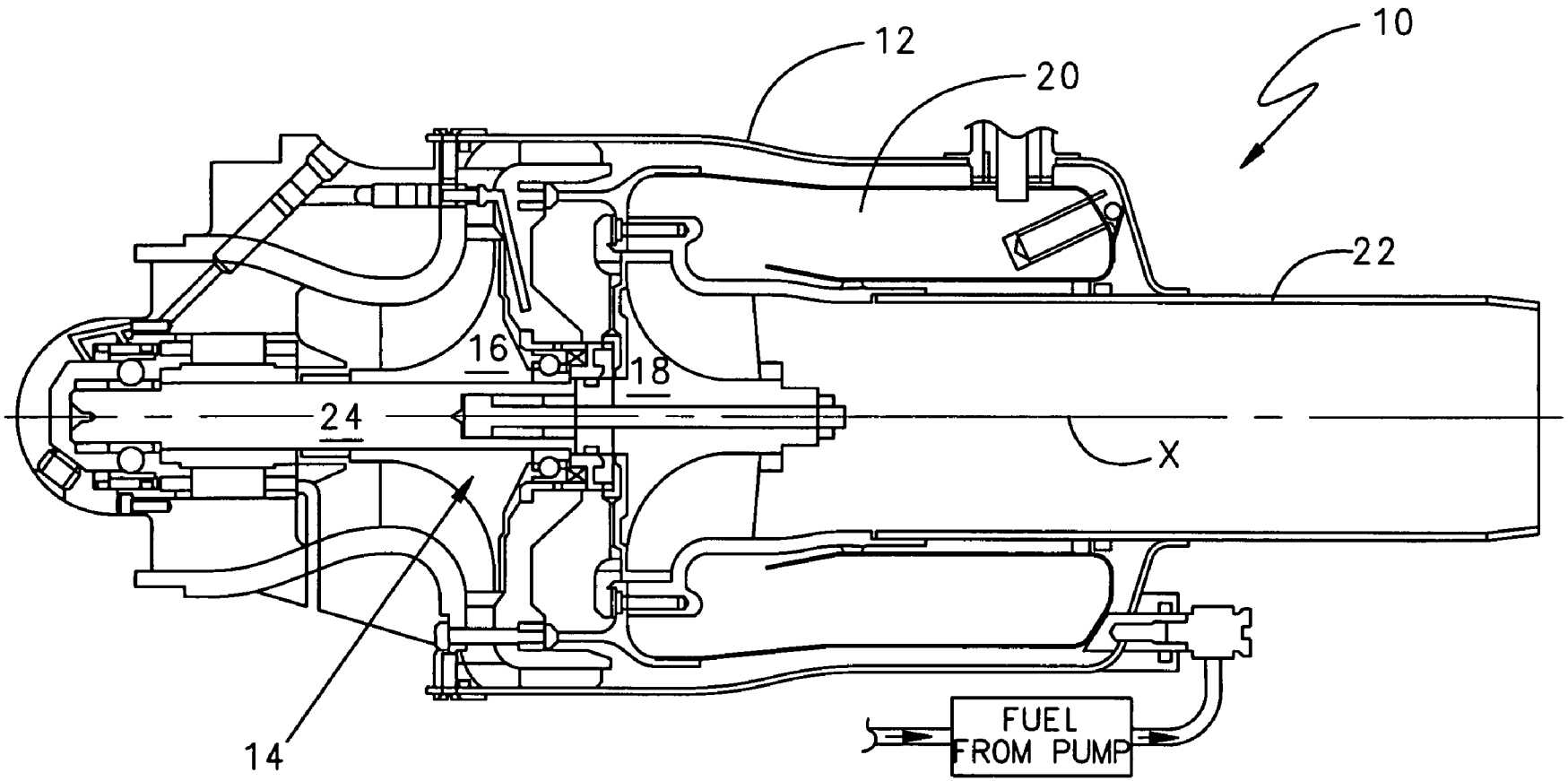
FIG. 1 is a schematic sectional view of a gas turbine engine with a coupling designed according to the present invention.

FIG. 1 illustrates a general sectional schematic view of a gas turbine engine 10 which generally includes a housing 12, a rotor system 14 which rotates about a longitudinal axis X, a combustion system 20 and an exhaust 22. The rotor system includes a compressor rotor 16 and a turbine rotor disc 18 mounted to a rotor shaft 24. In the illustrated rotor configuration, the rotor system 14 includes a ceramic turbine rotor disc 18 mounted to a metallic rotor shaft 24 at a coupling 26. It should be understood that although a gas turbine engine is illustrated in the disclosed embodiment, various shafts coupling segments for various applications will also benefit from the present invention.

Figure 2:
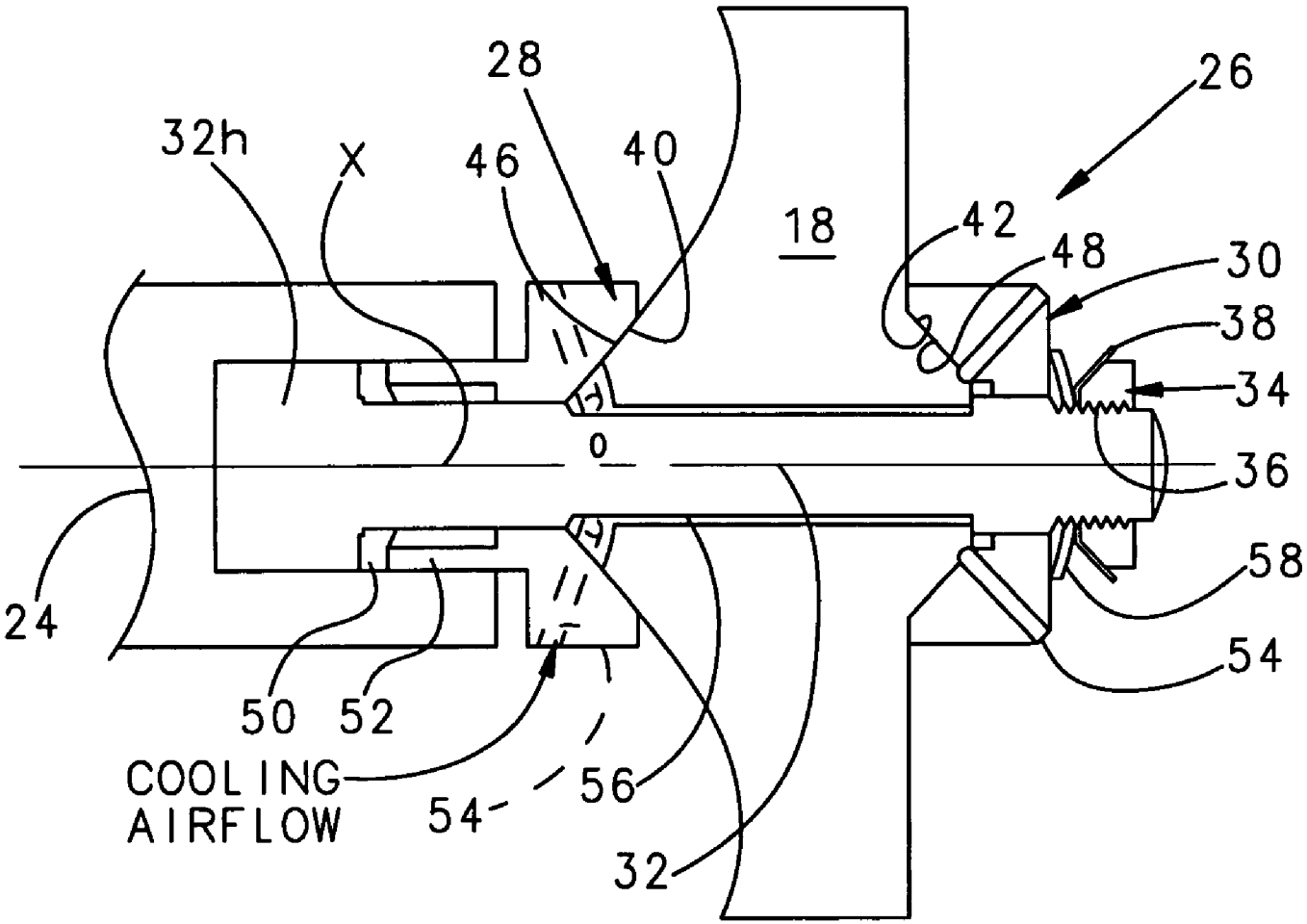
FIG. 2 is a sectional view of a coupling designed according to the present invention.

Referring to FIG. 2, the coupling 26 includes a first wedge clamp 28 and a second wedge clamp 30 mounted together by a tie-bolt 32. A fastener 34 such as a nut engages a threaded end segment 36 of the tie-bolt 32 to sandwich the ceramic turbine rotor disc 18 between the wedge clamps 28, 30. Preferably, an axial spring 38 such as a Bellville washer is positioned between the fastener 34 and the second wedge clamp 30 to apply an axial preload along the longitudinal axis X.

The ceramic turbine rotor disc 18 includes a first rotor radial surface 40 and a second rotor radial surface 42 non-perpendicular to the longitudinal axis X. The first rotor radial surface 40 and the second rotor radial surface 42 are preferably frustro-conical sloped surfaces at an angle of 45 degrees to the longitudinal axis X. The first wedge clamp 28 and the second wedge clamp 30 define respective first and second radial surfaces 44, 46 which correspond to the first rotor radial surface 40 and the second rotor radial surface 42.

The tie-bolt 32 includes a head 32*h* which is preferably polygonal in shape. The head 32*h* is received within a polygonal aperture 50 within the metallic rotor shaft 24 such that rotation is transferred therebetween. Preferably, the metallic rotor shaft 24 supports the compressor rotor 16 (FIG. 1) while the tie-bolt 32 supports the ceramic turbine rotor disc 18.

The first wedge clamp 28 preferably includes a neck 52 which is polygonal in cross-sectional shape for receipt into the polygonal aperture 50. The neck 52 facilitates transfer of rotation between the metallic rotor shaft 24, the tie-bolt 32 and ceramic turbine rotor disc 18. It should be understood that although polygonal cross-section as utilized herein is but one axial sliding but rotationally restrained attachment interface and that other interfaces such as slot and key arrangements will also be usable with the present invention.

During engine assembly, the first wedge clamp 28, ceramic turbine rotor disc 18, second wedge claim 30, axial spring 38 and fastener 34 are mounted to the tie-bolt 32. The head 32*h* and the neck 52 are inserted into the polygonal aperture 50 of the metallic rotor shaft 24. It should be understood that friction fit, shrink fit or clearance fits, as well as brazed attachments may alternatively or additionally be utilized to mount the metallic rotor shaft 24 to the metallic tie-bolt 32.

Tightening of the fastener 34 onto the tie-bolt 32 compresses the axial spring 38 and sandwiches the ceramic turbine rotor disc 18 between the wedge clamps 28, 30 to apply an axial preload to the ceramic turbine rotor disc 18. The pre-load preferably exerts a predetermined force on the ceramic turbine rotor disc 18 such that during engine operation, the ceramic turbine rotor disc 18, and the wedge clamps 28, 30 displace radially due to centrifugal and thermal loading. Because of the differences in coefficient of Thermal Expansions (CTEs), temperatures, material stiffness and density, these components deform differently in the radial direction. As a result of this, some sliding is expected between the radial surfaces 46, 48 and the adjacent rotor radial surfaces 40, 42. The high centrifugal loading on the ceramic turbine rotor disc 18 tends to experience deformation greater than the wedge clamps 28, 30. Consequently, the ceramic turbine rotor disc 18 tends to expand radially more than the wedge clamps 28, 30. During the engine shut-down, however, the reverse is true. Additionally, axial deformation resulting from heating and Poisson effect may result in further relative sliding between the ceramic turbine rotor disc 18 and the wedge clamps 28, 30. Despite the sliding, the first and second radial surfaces 44, 46 and the first and second rotor radial surfaces 40, 42, being frustro-conical surfaces, maintain the components in alignment about the longitudinal axis X.

Since one main cause of ceramic component failure is highly localized contact stress, sliding motion between the ceramic turbine rotor disc 18 and the wedge clamps 28, 30 may exacerbate the high contact stress situation and lead to pre-mature component failure. Applicant has determined that the preferred 45 degree contact angle between the first and second radial surface 44, 46 and the first and second rotor radial surfaces 40, 42 in conjunction with the axial preload applied by the axial spring 38 and fastener 34 minimize relative sliding and associated stress. Moreover, the wedge clamps 28, 30 axially follow the deformation of the ceramic rotor 18 due to the preload applied by the axial spring 38 to still further minimize the contact stresses.

The wedge clamps 28, 30 preferably include a multitude of cooling apertures 54 within the wedge clamps 28, 30 which permit cooling airflow from the compressor side of the engine through the first wedge clamp 28, an inner bore 56 of the ceramic turbine rotor disc 18 and the second wedge clamp 30. The cooling apertures 54 are preferably directed from an outer perimeter of the wedge clamps 28, 30 radially inward toward the inner bore 56. It should be understood that although only single apertures are illustrated, it should be understood that a multitude of radially extending cooling apertures 54 are defined about the periphery of the wedge clamps 28, 30. Since torque is transmitted between the ceramic hub and the metal edge through friction, it is beneficial to have high frictional coefficient. However, it is desirable to provide relatively easy sliding and therefore low friction between the two to accommodate thermal growth mismatch during start-up and shutdown. As such, it is preferred that an orthotropic distribution of friction requirement be provided, i.e., high friction coefficient in the hoop direction and low friction in the azimuthal direction. The orthotropic distribution of friction is preferably achieved by grinding the ceramic hub and the metal wedge in the azimuthal direction. Such grinding introduces minute grooves in the same direction. The grooves increase friction in the hoop direction, but facilitate sliding in the azimuthal plane.

An anti-rotation locking plate 58 is preferably located between the fastener 34 and the second wedge clamp 30 to prevent loosening of the fastener 34 during rotor spool down.

Figure 3:
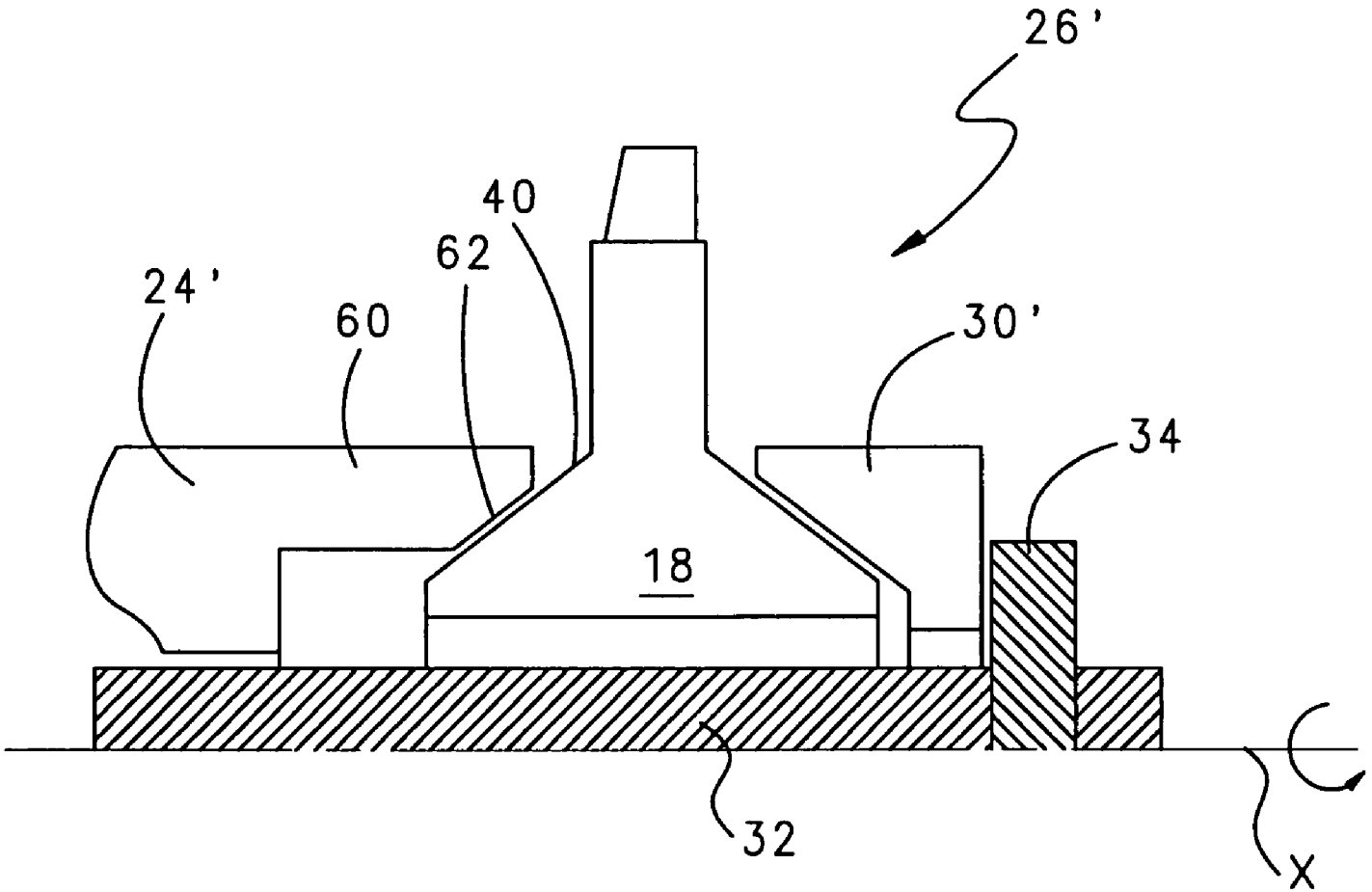
FIG. 3 is a sectional view of another coupling designed according to the present invention.

Referring to FIG. 3, another the coupling 26" utilizes a rotor shaft end segment 60 of a metallic rotor shaft 24' as a wedge clamp. That is, the rotor shaft end segment 60 includes an angled radial contact surface 62 to directly contact the first rotor radial surface 40 of the ceramic turbine rotor disc 18. In other words, the rotor shaft end segment 60 defines a hollow frustro-conical aperture.

Figure 4:
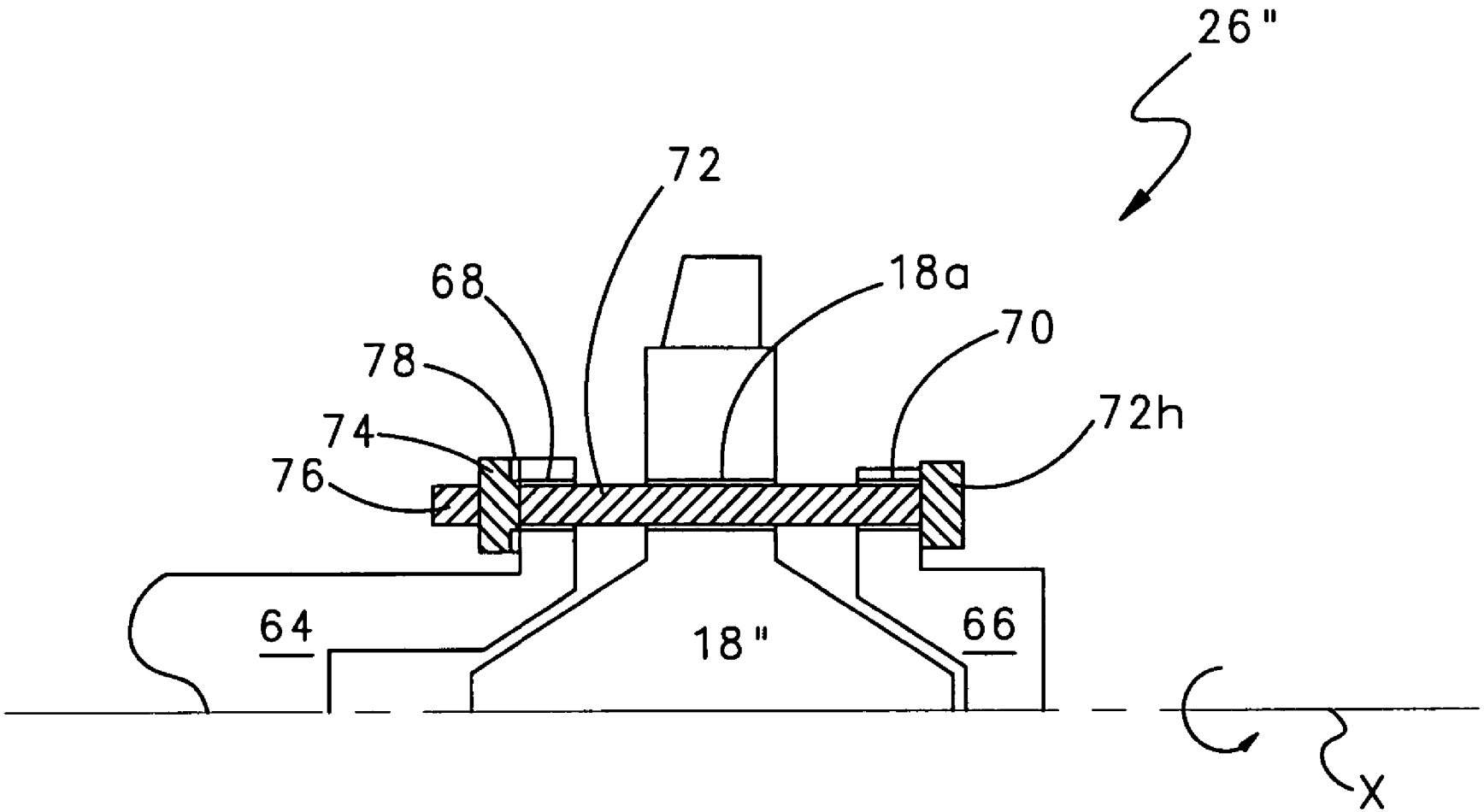
FIG. 4 is a sectional view of another coupling designed according to the present invention.

Referring to FIG. 4, the coupling 26" includes a solid ceramic turbine rotor disc 18' that does not utilize an inner bore. The solid ceramic turbine rotor disc 18" includes a multiple of tie-bolt apertures 18*a* radially displaced from the longitudinal axis X. The first and second wedge clamps 64, 66 include corresponding apertures 68, 70 to receive a tie-bolt 72 located there through. The tie-bolts 72 are mounted to the wedge clamps 64, 66 with a tie-bolt head 72*h* on one end and a threaded fastener 74 adjacent a threaded end segment 76 adjacent the other. It should be understood that various fasteners which provide an axial preload between the wedge clamps 64, 66 will also be usable with the present invention. That is, a multiple of tie-bolts 72 are radially displaced from the longitudinal axis X to exert a preload on the solid ceramic rotor disc 18" between the wedge clamps 64, 66 displaced about the longitudinal axis X. Axial springs 78 are also located between the fastener 74 and the wedge clamps 64, 66 to exert the preload as described above.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A rotor assembly coupling comprising:

a disc manufactured of a non-metallic material which defines an axis of rotation, said disc defining a first radial surface non-perpendicular to said axis and a second radial surface non-perpendicular to said axis;

a first wedge clamp mounted to engage said first radial surface;

a second wedge clamp mounted to engage said second radial surface;

a multitude of tie-bolts displaced from said axis of rotation, said multitude of tie-bolts mounted through said first wedge clamp, said disc and said second wedge clamp; and a fastener mounted to said tie-bolt to apply an axial load which sandwiches said disc between said first wedge clamp and said second wedge clamp.

2. The rotor assembly as recited in claim 1, wherein said first radial surface and said second radial surface are frustro-conical surfaces.

3. The rotor assembly as recited in claim 1, wherein said first radial surface and said second radial surface are opposed.

4. A rotor assembly coupling comprising:

a disc manufactured of a non-metallic material which defines an axis of rotation, said disc defining a first radial surface non-perpendicular to said axis and a second radial surface non-perpendicular to said axis;

a first wedge clamp mounted to engage said first radial surface;

a second wedge clamp mounted to engage said second radial surface;

a tie-bolt mounted through said first wedge clamp, said disc and said second wedge clamp, said tie-bolt includes a polygonal head received within a second shaft segment which defines a polygonal opening along said axis to rotationally lock said tie-bolt with said second shaft segment; and a fastener mounted to said tie-bolt to apply an axial load which sandwiches said disc between said first wedge clamp and said second wedge clamp.

5. The rotor assembly as recited in claim 4, wherein said first wedge clamp includes a polygonal neck which fits within said polygonal opening.

6. A gas turbine rotor assembly comprising:

a turbine rotor disc manufactured of a non-metallic material and defining an axis of rotation, said turbine rotor defining a first radial surface non-perpendicular to said axis and a second radial surface non-perpendicular to said axis;

a first wedge clamp mounted to engage said first radial surface;

a second wedge clamp mounted to engage said second radial surface;

a tie-bolt mounted through said first wedge clamp, said turbine rotor disc and said second wedge clamp said tie-bolt located along said axis of rotation and at least partially received within a rotor shaft, said first wedge clamp includes a polygonal neck received within a polygonal opening formed within said rotor shaft; and a fastener mounted to said tie-bolt to apply an axial load which sandwiches said turbine rotor disc between said first wedge clamp and said second wedge clamp.

7. The rotor assembly as recited in claim 6, wherein said rotor shaft supports a compressor rotor.

8. The rotor assembly as recited in claim 6, wherein said first radial surface and said second radial surface are frustro-conical surfaces.

9. The rotor assembly as recited in claim 6, wherein said first radial surface and said second radial surface define an approximately 45 degree angle relative to said axis.

10. The rotor assembly as recited in claim 6, wherein said first wedge clamp and said second wedge clamp define a multitude of cooling apertures, said multiple of cooling apertures in communication with an inner bore of said turbine rotor through which said tie-bolt is received.

11. A gas turbine engine comprising:

a rotor shaft;

a compressor rotor mounted to said rotor shaft;

a turbine rotor disc manufactured of a non-metallic material, said turbine rotor defining a first frustro-conical surface and a second frustro-conical surface;

a first wedge clamp mounted adjacent to said first frustro-conical surface said first wedge clamp includes a polygonal neck received within a polygonal opening formed within said rotor shaft;

a second wedge clamp mounted adjacent to said second frustro-conical surface;

at least one tie-bolt mounted through said first wedge clamp, said turbine rotor disc and said second wedge clamp; and a fastener mounted to said at least one tie-bolt to apply an axial load which sandwiches said turbine rotor disc between said first wedge clamp and said second wedge clamp.

12. The gas turbine engine as recited in claim 11, wherein said first frustro-conical surface and said second frustro-conical surface define an approximately 45 degree angle relative to said axis.

13. The gas turbine engine as recited in claim 11, wherein said first wedge clamp and said second wedge clamp define a multitude of cooling apertures, said multiple of cooling apertures in communication with an inner bore of said rotor through which said tie-bolt is received such that a cooling airflow passes from said compressor rotor, through said first wedge clamp, through said inner bore and exits from said second wedge clamp.

14. The gas turbine engine as recited in claim 11, wherein said first wedge clamp is formed into an end segment of said rotor shaft.

* * * * *

UNITED STATES PATENT AND TRADEMARK OFFICE

CERTIFICATE OF CORRECTION

PATENT NO. : 7,527,479 B2
APPLICATION NO. : 11/221440
DATED : May 5, 2009
INVENTOR(S) : Shi et al.

It is certified that error appears in the above-identified patent and that said Letters Patent is hereby corrected as shown below:

On the Title Page; Item (75)

Change “Connic” to read as --Connie--

Signed and Sealed this

Twenty-first Day of July, 2009

John Doll

JOHN DOLL
*Acting Director of the United States Patent and Trademark Office*